US007591960B2

(12) United States Patent
Chung

(10) Patent No.: US 7,591,960 B2
(45) Date of Patent: Sep. 22, 2009

(54) PREPARATION METHOD FOR OIL-BASED MAGNETIC FLUID

(75) Inventor: Jen-Chieh Chung, Longtan Township, Taoyuan County (TW)

(73) Assignee: Atomic Energy Council-Institute of Nuclear Energy Research, Taoyuan County (TW)

( * ) Notice: Subject to any disclaimer, the term of this patent is extended or adjusted under 35 U.S.C. 154(b) by 249 days.

(21) Appl. No.: 11/354,038

(22) Filed: Feb. 15, 2006

(65) Prior Publication Data

US 2007/0187637 A1 Aug. 16, 2007

(51) Int. Cl.
*H01F 1/44* (2006.01)

(52) U.S. Cl. ..... 252/62.52

(58) Field of Classification Search ..... 252/62.52
See application file for complete search history.

(56) References Cited

FOREIGN PATENT DOCUMENTS

JP 2007-165482 * 6/2007

* cited by examiner

*Primary Examiner*—C. Melissa Koslow
(74) *Attorney, Agent, or Firm*—Rosenberg, Klein & Lee

(57) ABSTRACT

A preparation method for synthesis of oil-based magnetic fluid is disclosed. One end of a compound with a diamino group or an organic extraction reagent is connected with oil-based material while the other end is connected with surfactant having a carboxyl group that further reacts with magnetic metal oxide nanoparticles containing surfactant to form a stable useful oil-based magnetic fluid. The present invention is applied to process wastewater with oil, organic compounds or inorganic metal ions. Under the control of the magnetic field, the floating oil on the water surface is collected. The method can also be applied to the separation as well as collection of materials in the water such as organic compounds and metals.

16 Claims, 2 Drawing Sheets

PREPARATION METHOD FOR OIL-BASED MAGNETIC FLUID

BACKGROUND OF THE INVENTION

1. Field of the Invention

The present invention relates to a preparation method for magnetic fluid, especially to oil-based magnetic fluid that absorbs organic material, oil-based material and metal ions inside the fluid. Then by the application of the magnetic field, the absorbed material is separated from the fluid so as to achieve the purposes of fluid treatment or purification.

2. Description of the Related Art

Magnetic materials have been applied broadly to recording tapes, magnetic materials for memory such as magnetic disks or tapes, building materials such as ink, paint, and mechanical parts such as electromagnetic switches, or seals. By the development of new preparation method, magnetic materials are applied in more fields such as biomedicine for purification of drugs, protein and DNA or environmental waste treatment.

For example, U.S. Pat. No. 4,687,748 applied in 1987 discloses magnetically responsive spheres having an average diameter less than 1,000 nm, prepared by dissolving a carbohydrate polymer in a polar solvent and being applied to cell separation as well as affinity purification. Basically, such magnetic separation techniques have two types according to features of material being processed (1) apply the magnetic field to separate material itself with magnetic properties. (2) combine material without magnetic properties with magnetic material by chemical reactions and then apply the magnetic field for separation. In combination of the material without magnetic properties with magnetic material, various types and preparation methods of magnetic material play important roles.

There are various preparation methods for magnetic material according to users' requirement. The most common is (1) grinding: refer to U.S. Pat. 4,604,222, applied in 1986, magnetic fluid is prepared by mixing of magnetic particles, dispersing agent such as a cationic surfactant and organic liquid carrier such as an ester or a glycol and then employing a grinding or ball mill technique so as to improve electrical conductivity and seal computer disc drives. (2) oxidation reaction: such as U.S. Pat. No. 6,140,001, applied in 2000, disclosing a method that mix a solution of a soluble phosphate compound such as sodium orthophosphate with a solution of ferrous ion, and alkali or alkaline hydroxide solution to form ferrous hydroxide. Then an oxidation step is performed by passing an oxygen-containing gas through the mixture. Finally, the iron oxide particles of the invention will precipitate from the solution. (3) chemical coprecipitation: refer to U.S. Pat. No. 6,743,371, applied in 2004, disclosing magnetic fluid prepared by mixture of magnetic sensitive particles such as nickel-zinc ferrite or manganese-zinc ferrite and conductive particles such as gold, silver, copper, aluminum and graphite. The magnetic fluid is utilized in electrical switching applications. Because the magnetic particles attract each other and thus aggregate, it is necessary to take surface treatment step during preparation process for effectively separation of particles. Not only the diameter of particles is smaller, but the particles are more easily to be dispersed inside the solvent. The ways of surface treatment are different depending on hydrophilic or lipophilic characteristics of the oil-based magnetic fluid being prepared.

As to the preparation of lipophilic oil-based magnetic fluid, refer to U.S. Pat. No. 5,124,060, applied in 1992, a method includes steps of adding the low boiling organic solvent and the dispersant having oleophilic groups to separate particles and heating the resulting material to evaporate the low boiling organic solvent thereby obtaining a magnetic fluid that is applied to seal vacuum apparatus. Moreover, U.S. Pat. 6,068,785, applied in 2000, disclosing a slurry is formed of particles of a non-magnetic oxide of iron (.alpha.-Fe.sub.2 O.sub.3), an oil carrier liquid and a surfactant. The slurry is then processed in an attrition mill to generate magnetic iron oxide particles for form an oil-based material. Due to direct grinding operation, oil and surfactant may attach on surface of magnetic particles so as to make the surface coating fall off. This leads to negative effect on yield rate.

Generally, magnetic fluid is more applied to magnetic materials for memory and design of mechanical seal. However, it's seldom used in eliminating organic compounds or oil inside the water and processing metal ions inside the inorganic wastewater. Conventionally, organic wastewater is processed by heat treating or chemically oxidation. This not only costs much but also generates secondary wastewater due to addition of chemicals. As to wastewater with metal ions, besides conventional chemical precipitation, physical treatment methods such as membrane technologies can also be used. Although there is no addition of chemicals, it requires higher equipment cost and more technical support.

In order to make the oil-based magnetic fluid have lipophilic interface and strong binding force between the magnetic metal oxide particles, the present invention adds surfactant with a carboxyl group during the preparation process of iron oxide so as to generate the magnetic material such as iron oxide with the carboxyl group. Then, the material further reacts with oil material to form oil-based magnetic fluid by crosslinking reaction. The bonding between the magnetic material and the compounds is formed by chemical reaction. Thus the final product has higher bonding force between molecules with better stability.

Thus the oil-based magnetic fluid in accordance with the present invention can react with oils, organic compounds, and metal ions inside water and then being separated by the application of magnetic field. The present invention has advantages of no addition of chemicals, simple equipment and easy operation.

SUMMARY OF THE INVENTION

It is therefore a primary object of the present invention to provide a preparation method for oil-based magnetic fluid that combines magnetic material with oil-based material by crosslinking reaction of functional groups to form chemical bonds therebetween. By the application of magnetic field, the oil-based magnetic fluid absorbs organic compounds or metal ions for separation from solution. Thus the purposes of fluid treatment or purification are achieved.

It is another object of the present invention to provide a preparation method for oil-based magnetic fluid. The oil-based magnetic fluid has both magnetism and mobility of fluid. While being mixed with fluid such as wastewater, the oil-based magnetic fluid absorbing organic material and metal ions is insolvable with water. During the process of fluid treatment, there is no need to add catalyst, oxidizing agent or other chemicals. Not only the cost for treatment is saved, but also the recovery process of the catalyst is left out. At the same time, by magnetism, the oil-based magnetic fluid absorbing organic material and metal ions is separated with water rapidly and it's convenient to operate.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
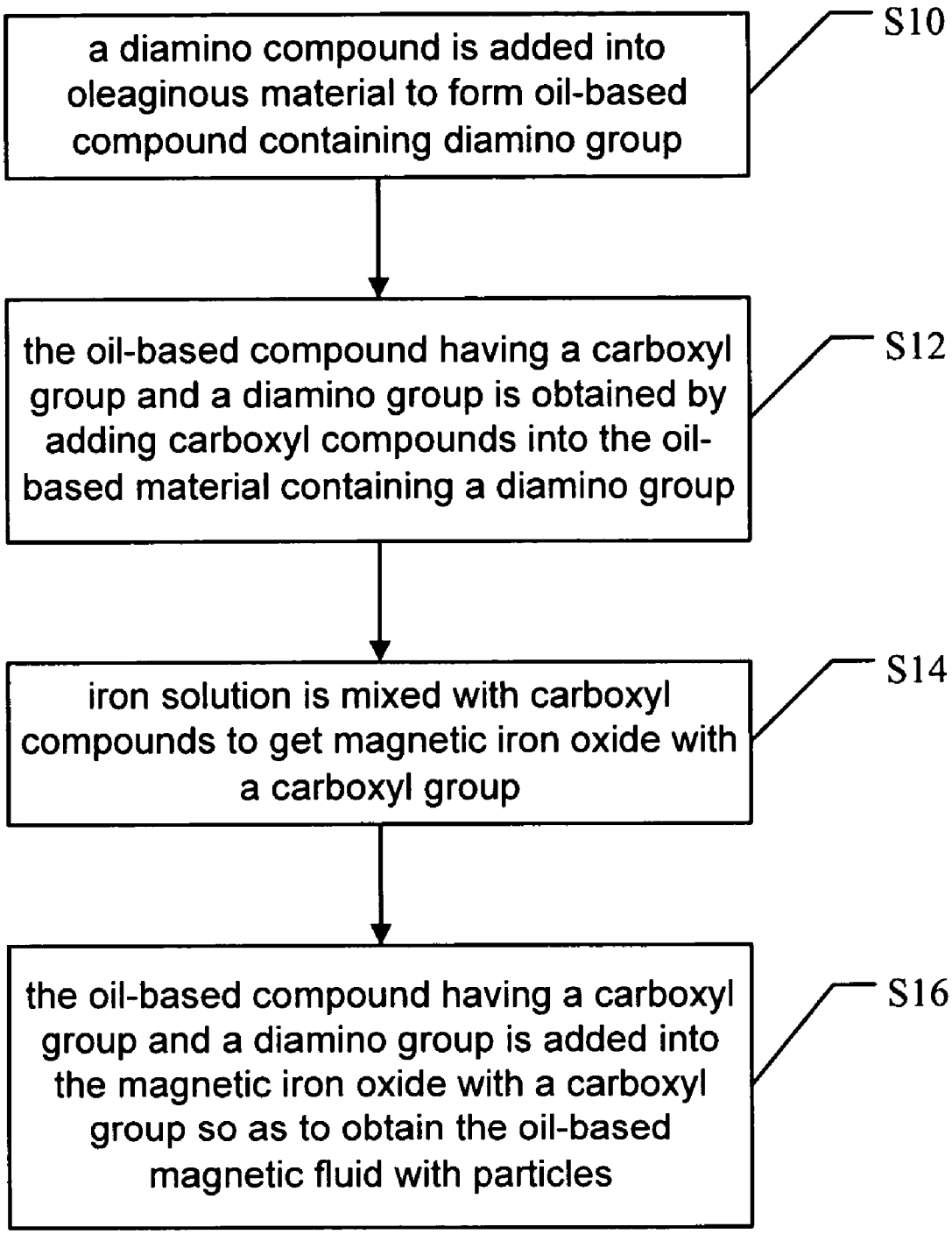
FIG. 1 is a flow chart for preparation of an embodiment of oil-based magnetic fluid in accordance with the present invention.

Refer to FIG. 1, in step S10, a diamino compound is added into oleaginous material to form oil-based compound containing diamino group. Refer to step S12, the oil-based compound having a carboxyl group and a diamino group is obtained by adding carboxyl compounds into the oil-based material containing a diamino group. In step S14, iron solution is mixed with carboxyl compounds to get magnetic iron oxide with a carboxyl group. Refer to step S16, the oil-based compound having a carboxyl group and a diamino group is added into the magnetic iron oxide with a carboxyl group so as to obtain the oil-based magnetic fluid with particles whose diameter ranges from 60 to 100 nanometers.

In step S10, an embodiment is taking as an example. The compound containing a diamino group such as urea is dissolved into the water. Then add into the same amount of alcohol so as to make the concentration of the urea become 24 to 30% weight/volume ratio and the mixture is heated inside the reflux condenser at the temperature ranging from 70 to 90 Celsius degrees and 75 Celsius degrees is the preferable temperature. Moreover, take some oil (such as vegetable oil or other organic oils) and dilute it with equal volume of ethyl acetate. The diluted oil is dropped into the hot urea solution so as to make the volume ratio between the oil and the urea solution be two. Continuingly heat the resulting mixture for thirty minutes. After the solution cooling down to room temperature, wash it with water and centrifugate the solution to get the raw urea synthetic oil. Repeat the steps of washing and centrifugation several times, the product is urea synthetic oil. That's oil-based compound with a diamino group.

Take an embodiment for explanation of step S12. The urea synthetic oil is stirred and heated to 85 Celsius degrees in the reflux condenser. Then slowly add the carboxyl compound solution, such as undecenoic acid, oleic acid, lauric acid, or caproic acid, into the urea synthetic oil until the volume ratio of the carboxyl compound solution to the urea synthetic oil becomes 1/5. Continuingly heat the resulting mixture for 30 minutes. Then let it cool down to room temperature, add alcohol into the solution and washing the mixture. After centrifugation, oil-based material having carboxyl group and urea is obtained. The oil-based material having carboxyl group and urea made by condensation reaction between the undecenoic acid and an amino-terminal of the urea is an oil-based compound having a carboxyl group and a diamino group.

In step S14, ferrous chloride and ferric chloride are dissolved inside deoxidized water and the molecular ratio between them is from 1/2 to 1/3. The solution is heated to 80 Celsius degrees inside the reflux condenser. Then slowly add the carboxyl compound solution (such as undecenoic acid) about 2.4% volume ratio into the solution and continuingly heat the solution. Take an amount of 25% ammonia water, diluted with equal amount of alcohol and ethyl acetate and pour into solution inside the reflux condenser. The ammonia water occupies about 20% of the total volume. Keep heating at 80 Celsius degrees for thirty minutes. Then cool down the mixture to 65 Celsius degrees and keeps in this temperature for 5 hours and thirty minutes so as to get the precipitation of magnetic iron powder with a carboxyl group. Magnetically decant clear supernatant, wash the precipitation with alcohol several times and then preserve in a bit alcohol solution. Or after decanting clear supernatant, dry the precipitation at room temperature so as to get the magnetic iron powder with a carboxyl group. That's magnetic iron oxide coated with a carboxyl group.

In step S16, add carboxyl urea synthetic oil into magnetic iron powder with a carboxyl group and heat inside the reflux condenser at the temperature from 65 to 80 Celsius degrees for thirty minutes. The temperature is preferably 85 Celsius degrees.

After washing with alcohol, water, and separation, the stable oil-based magnetic solution is obtained. The composition of the solution includes iron oxide $Fe_3O_4$.

Figure 2:
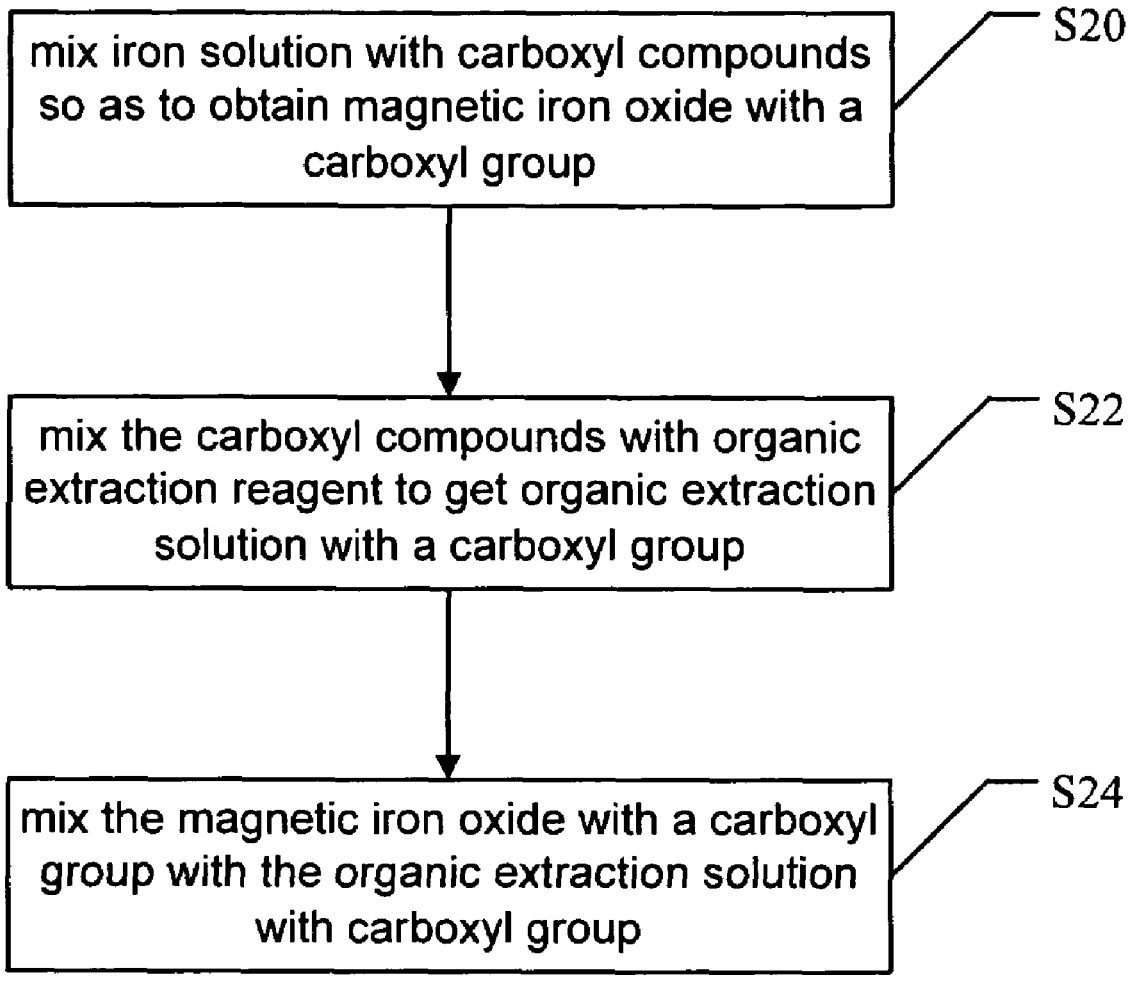
FIG. 2 is a flow chart for preparation of another embodiment of oil-based magnetic fluid with organic extraction solvent in accordance with the present invention.

Refer to FIG. 2, in the step S20, mix iron solution with carboxyl compounds so as to obtain magnetic iron oxide with a carboxyl group. Take the step S22, mix the carboxyl compounds with organic extraction reagent to get organic extraction solution with a carboxyl group. In step S24, mix the magnetic iron oxide with a carboxyl group with the organic extraction solution with carboxyl group, then add the organic extraction solution with oleaginous material into the mixture so as to get oil-based magnetic fluid.

Dissolve 2.78 gm ferrous sulfate in 100 ml pure water and heat the solution to 85 Celsius degrees. Add 1 ml undecenoic acid into the solution, stir and heat at 85 Celsius degrees inside the reflux condenser. Add 10 cc 10% sodium hydroxide into the mixture drop by drop and keep heating the solution at 85 Celsius degrees in the reflux condenser for an hour. Magnetically decant the solution, wash with acetone for several times, put into the reflux condenser. Slowly add the mixture of 10 ml tributyl phosphate (TBP) with 1 ml undecenoic acid into the reflux condenser and heat for an hour. Again magnetically decant the solution, wash with acetone for several times, then wash several times again with 30% solution of tributyl phosphate in kerosene. Then the product is dispersed inside the 30% solution of tributyl phosphate in kerosene. This is oil-based magnetic fluid.

In summary, oil-based magnetic fluid in accordance with the present invention is used in combination with external magnetic field for absorption of floating oil on water surface and separation as well as treatment of organic compounds, metal ions and oil in wastewater.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A preparation method for magnetic fluid comprising the steps of:

adding a diamino compound of urea into an oleaginous material of an organic oil to form an oil-based compound containing a diamino group;

adding a carboxyl compound selected from the group consisting of undecenoic acid, oleic acid, lauric acid and caproic acid into the oil-based compound containing said diamino group to obtain an oil-based compound having a carboxyl group and said diamino group;

mixing an iron solution with another carboxyl compound to obtain a magnetic iron oxide with said another carboxyl group; and adding the oil-based compound having said carboxyl group and said diamino group into the magnetic iron oxide with said carboxyl group to obtain an oil-based magnetic fluid, wherein in the step of mixing the iron solution with said carboxyl compound to obtain the magnetic iron oxide with said carboxyl group, the carboxyl compound is undecenoic acid, the step of mixing the iron solution with the carboxyl compound further comprising the steps of:

dissolving ferrous chloride and ferric chloride in deoxidized water to obtain a solution of the ferrous and ferric chlorides, wherein the molecular ratio between ferrous chloride and ferric chloride ranges from 1/2 to 1/3;

heating said solution to 80 Celsius degrees inside a reflux condenser, adding the heated solution into the undecenoic acid and continuingly heating a resulting solution;

diluting ammonia water with alcohol and ethyl acetate, thereby obtaining a dilution, pouring the dilution into the reflux condenser to obtain a mixture, and heating the mixture at 80 Celsius degrees for thirty minutes;

cooling down the mixture to 65 Celsius degrees for 5 hours and thirty minutes to obtain the precipitation of undecenoic acid-magnetic iron powder; and decanting clear supernatant to obtain the undecenoic acid-magnetic iron powder, containing the magnetic iron oxide with said carboxyl group.

2. The method as claimed in claim 1, wherein the oleaginous material is a vegetable oil.

3. The method as claimed in claim 1, wherein in the step of adding said diamino compound into said oleaginous material to form said oil-based compound containing said diamino group, the oleaginous material is a vegetable oil, and wherein the manufacturing method further comprises the steps of:

dissolving the urea in the water to form an amount of solution, adding the same amount of alcohol, and heating the mixture inside the reflux condenser at the temperature ranging from 70 to 90 Celsius degrees to obtain urea solution;

taking 50 ml vegetable oil, diluting the vegetable oil with 50 ml of ethyl acetate, dropping diluted oil into the urea solution, and heating the resulting mixture for thirty minutes; and cooling down the resulting mixture to room temperature, washing with water and centrifugating for separation of oil-based compound and said diamino group including urea vegetable oil.

4. The method as claimed in claim 3, wherein concentration of the urea ranges from 24% to 30% weight/volume ratio.

5. The method as claimed in claim 3, wherein volume ratio between the vegetable oil and the urea solution is two.

6. The method as claimed in claim 3, wherein the temperature inside the reflux condenser is 75 Celsius degrees.

7. The method as claimed in claim 1, wherein in the step of adding said carboxyl compound into the oil-based compound containing said diamino group to obtain the oil-based compound having said carboxyl group and said diamino group, the oil-based compound containing said diamino group includes a urea organic oil, wherein the carboxyl compound is undecenoic acid, wherein the step of adding the carboxyl compound into the oil-based compound further includes the steps of:

heating the urea organic oil to 85 Celsius degrees in the reflux condenser;

adding the heated urea organic oil into the undecenoic acid, and heating the mixture for thirty minutes; and cooling down the mixture to room temperature, adding alcohol, washing with water, centrifugating for separation of oil-based compound having said carboxyl group and said diamino group, including urea-undecenoic acid organic oil.

8. The method as claimed in claim 7, wherein volume ratio of the undecenoic acid to the urea organic oil is 1:5.

9. The method as claimed in claim 7, wherein the urea-undecenoic acid organic oil is made by condensation reaction between a carboxyl-terminal of the undecenoic acid and an amino-terminal of the urea.

10. The method as claimed in claim 1, wherein in the step of adding the oil-based compound having said carboxyl group and said diamino group into the magnetic iron oxide with said carboxyl group to obtain the oil-based magnetic fluid, the oil-based compound includes said carboxyl group and said diamino group is urea-undecenoic acid organic oil, wherein the magnetic iron oxide with said carboxyl group is undecenoic acid-magnetic iron powder, and wherein the step of adding the oil-based compound further includes the steps of:

adding the undecenoic acid-magnetic iron powder into the urea-undecenoic acid organic oil;

heating the mixture of the undecenoic acid-magnetic iron powder with the urea-undecenoic acid organic oil at 80 Celsius degrees in the reflux condenser for thirty minutes; and washing the mixture with alcohol and water, thereby separating of oil-based magnetic fluid.

11. The method as claimed in claim 1, wherein the oil-based magnetic fluid includes iron oxide $Fe_3O_4$.

12. The method as claimed in claim 1, wherein diameter of particles of the oil-based magnetic fluid ranges from 60 to 100 nanometers.

13. A preparation method for magnetic fluid comprising the steps of:

mixing iron solution with a carboxyl compound selected from the group consisting of undecenoic acid, oleic acid, lauric acid, and caproic acid so as to obtain magnetic iron oxide with a carboxyl group;

mixing a carboxyl compound selected from the group consisting of undecenoic acid, oleic acid, lauric acid, and caproic acid with an organic extraction reagent, wherein said organic extraction reagent is tributyl phosphate (TBP), to get organic extraction solution with a carboxyl group; and mixing the magnetic iron oxide with a carboxyl group with the organic extraction solution with a carboxyl group, then adding an organic extraction solution with oleaginous material, wherein said oleaginous material is kerosene, so as to get oil-based magnetic fluid.

14. The method as claimed in claim 13, wherein the iron solution is ferrous sulfate solution.

15. The method as claimed in claim 13, wherein ratio of the organic extraction reagent and the oleaginous material is 30%.

16. The method as claimed in claim 13, wherein the step of mixing iron solution with a carboxyl compound so as to obtain magnetic iron oxide with a carboxyl group further having a step of: adding into sodium hydroxide.

* * * * *